US011624502B1

(12) United States Patent
Holloway

(10) Patent No.: US 11,624,502 B1
(45) Date of Patent: Apr. 11, 2023

(54) LIGHTING SYSTEM FOR A SECTIONAL DOOR

(71) Applicant: Graham Holloway, Santa Maria, CA (US)

(72) Inventor: Graham Holloway, Santa Maria, CA (US)

( * ) Notice: Subject to any disclaimer, the term of this patent is extended or adjusted under 35 U.S.C. 154(b) by 0 days.

(21) Appl. No.: 17/886,656

(22) Filed: Aug. 12, 2022

(51) Int. Cl.

| | |
|---|---|
| ***F21V 33/00*** | (2006.01) |
| ***F21V 23/00*** | (2015.01) |
| ***F21V 21/35*** | (2006.01) |
| ***F21S 8/00*** | (2006.01) |
| ***F21Y 115/10*** | (2016.01) |

(52) U.S. Cl.
CPC ..... *F21V 33/006* (2013.01); *F21S 8/031* (2013.01); *F21V 21/35* (2013.01); *F21V 23/002* (2013.01); *F21V 33/0016* (2013.01); *F21Y 2115/10* (2016.08)

(58) Field of Classification Search
CPC ..... F21V 33/006; F21V 21/35; F21V 23/002; F21V 33/0016; F21S 8/031
See application file for complete search history.

(56) References Cited

U.S. PATENT DOCUMENTS

| | | | | |
|---|---|---|---|---|
| 5,034,861 | A * | 7/1991 | Sklenak | A47F 3/001 312/236 |
| 7,722,230 | B2 * | 5/2010 | Chien | H04N 23/51 362/276 |
| 9,976,738 | B1 * | 5/2018 | Holloway | E06B 3/485 |
| 10,066,812 | B1 * | 9/2018 | Esteves | F21V 21/005 |
| 10,717,386 | B1 * | 7/2020 | Holloway | F21V 33/006 |
| 10,731,807 | B1 * | 8/2020 | Holloway | E06B 3/822 |
| 10,785,852 | B1 * | 9/2020 | Stubbs | H05B 47/19 |
| 10,939,756 | B2 * | 3/2021 | Peck | A47B 96/024 |
| 2002/0047646 | A1 * | 4/2002 | Lys | F21S 4/28 315/312 |
| 2015/0285489 | A1 * | 10/2015 | Ulysse | H05B 47/115 362/183 |
| 2022/0364690 | A1 * | 11/2022 | Boroski | F21V 23/001 |

* cited by examiner

*Primary Examiner* — Bryon T Gyllstrom
(74) *Attorney, Agent, or Firm* — Ted Masters

(57) ABSTRACT

A lighting system attaches to a sectional door. The sectional door has a plurality of hinge-connected panels which roll along left and right tracks which are connected to a structure. Each panel has an inside surface. The sectional door is positionable to a closed position and to an open position. The lighting system includes a light which connects to the inside surface of a panel of the sectional door. A movable electric contactor connects to a panel of the sectional door, and a fixed electric contactor connects to the structure. A holder carries the fixed contactor, the holder is shaped and dimensioned to removably connect to either the left track or to the right track. In the open position of the sectional door the movable electric contactor is configured to contact the fixed electric contactor and energize the light. In an embodiment a tapered receptacle is connected to the fixed electric contactor and a cooperating tapered plug is connected to the movable electric contactor. The tapered receptacle and tapered plug ensure that the two contactors align when the sectional door is closed.

10 Claims, 10 Drawing Sheets

FIG. 9

FIG. 14
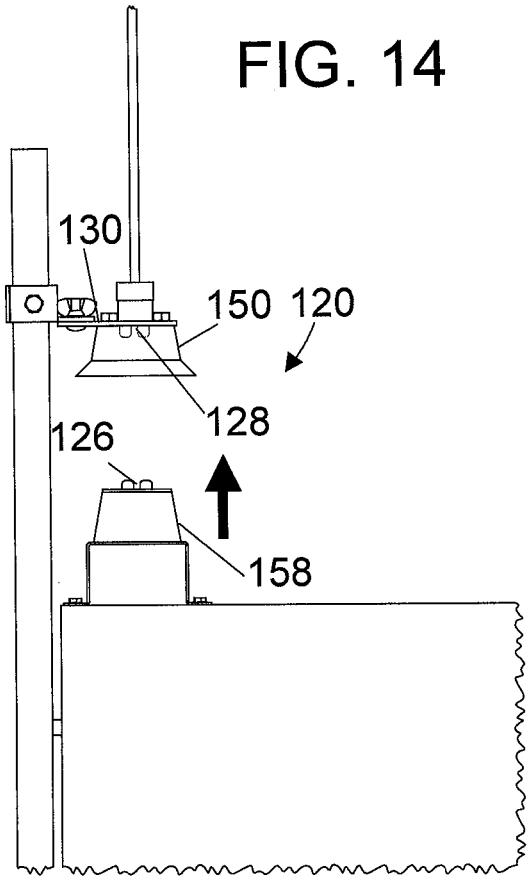
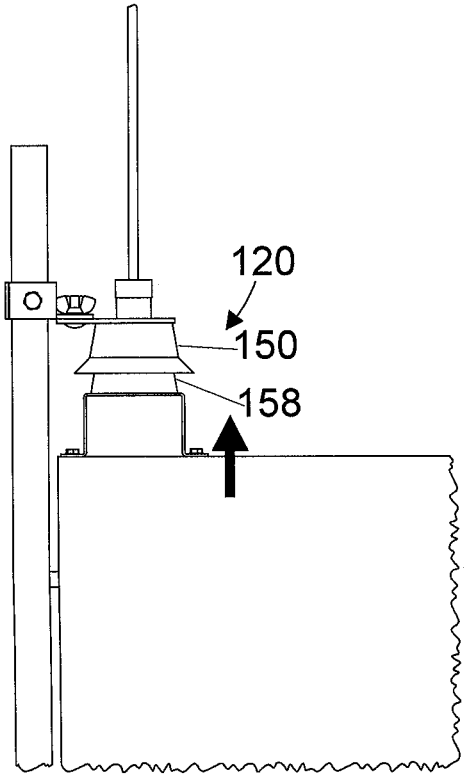
FIG. 15

FIG. 16
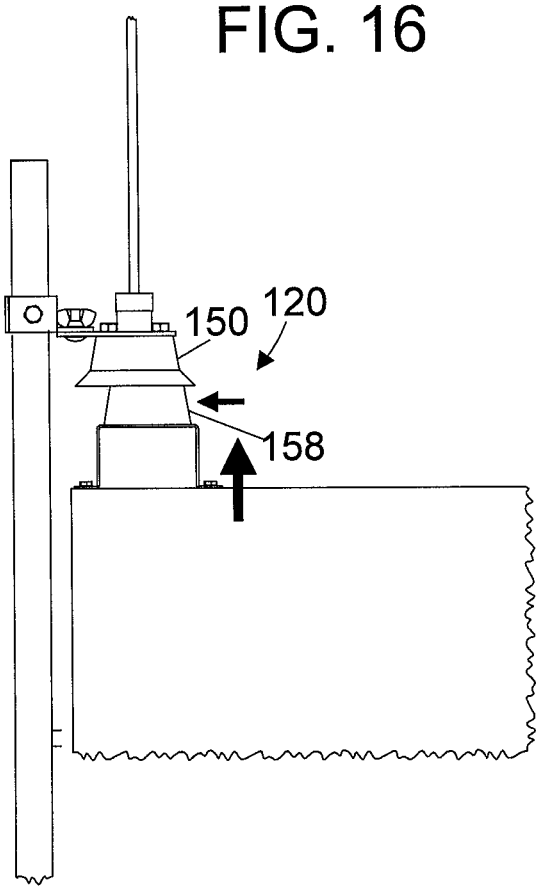
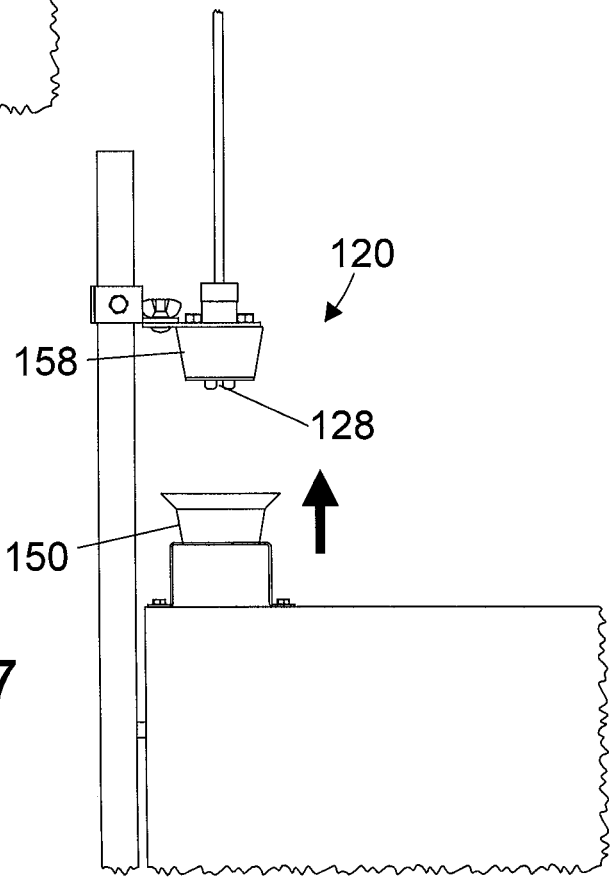
FIG. 17

LIGHTING SYSTEM FOR A SECTIONAL DOOR

CROSS REFERENCE TO RELATED APPLICATION

None

TECHNICAL FIELD

The present invention pertains generally to sectional doors, and more particularly to a lighting system which is attached to the inside surface of the door.

BACKGROUND OF THE INVENTION

Sectional doors are well known in the art, and consist of several hinge-connected panels which slide from a closed vertical position to an open horizontal overhead position. Each panel has rollers on its side edges which move in door tracks mounted to a structure. Sectional doors are typically used in fixed structures such as home garages and commercial buildings, and also in mobile structures such as trucks and delivery vans. A motorized opening and closing mechanism can be connected near the top of the door to effect the opening and closing action. A problem however exists with sectional doors. When the door is in the open horizontal overhead position, the door blocks light from light fixtures which are mounted on the ceiling of the structure. U.S. Pat. No. 9,976,738 which is included herein by reference, addresses this problem.

BRIEF SUMMARY OF THE INVENTION

The present invention is directed to a lighting system and method for a sectional door. The lighting system is connected to the inside surface of the sectional door and provides a high intensity light source. As such, the system solves the problem of blocked ceiling light when the sectional door is opened. Additionally the lighting system provides improved structure illumination for security reasons by allowing a better view of previously darkened areas. In an embodiment, the lighting system utilizes a longitudinal string of low voltage LED lights which are connected to each panel of the sectional door. The lighting system can be retrofit on existing structures such as garages, warehouses, or vehicles such as trucks and delivery vans, or can be included as original equipment.

The lighting system utilizes two electric contactors; a fixed contactor is mounted to the track of the sectional door, and a movable contactor is mounted to the top of the door. When the sectional door is opened, the contactors engage and complete an electrical circuit which energizes the lights, thereby lighting up the entire underside of the sectional door.

In accordance with an embodiment, a lighting system is disclosed for a sectional door which has a plurality of connected panels which roll along left and right tracks which are connected to a structure. Each panel has an inside surface, the sectional door is positionable to a closed position and to an open position. The lighting system includes a light which is connectable to the inside surface of a panel of the sectional door. A movable electric contactor is connectable to a panel of the sectional door. A holder carries the fixed contactor, the holder is shaped and dimensioned to removably connect to either the left track or to the right track. In the open position of the sectional door the movable electric contactor is configured to contact the fixed electric contactor and energize the light. A tapered receptacle has a mouth end and a base end, the fixed electric contactor is connected to the base end. A tapered plug has g a proximal end and a distal end, the movable electric contactor is connected to the distal end. The tapered plug is shaped and dimensioned to be received by the tapered receptacle.

In accordance with another embodiment, the tapered plug is received by the tapered receptacle so that the movable electric contactor contacts the fixed electric contactor.

In accordance with another embodiment, the tapered receptacle has a first flat side and an opposite second flat side, and the tapered plug has a first flat side and and an opposite second flat side.

In accordance with another embodiment, the tapered receptacle has a flared flange disposed at the mouth end.

In accordance with another embodiment, the tapered plug is movable to effect alignment of the movable contactor with the fixed electric contactor.

Other embodiments, in addition to the embodiments enumerated above, will become apparent from the following detailed description, taken in conjunction with the accompanying drawings, which illustrate, by way of example, the principles of the lighting system for a sectional door.

BRIEF DESCRIPTION OF THE DRAWINGS

FIG. 14 is an enlarged fragmented top plan view of the movable and fixed electric contactors as in FIG. 24;

FIG. 15 is an enlarged fragmented top plan view as in FIG. 14 showing the movable electric contactor contacting the fixed electric contactor;

FIG. 16 is an enlarged fragmented top plan view showing the movable electric contactor misaligned with the fixed electric contactor;

FIG. 17 is an enlarged fragmented top plan view showing the position of a tapered receptacle and a tapered plug reversed;

DETAILED DESCRIPTION OF THE INVENTION

Figure 1:
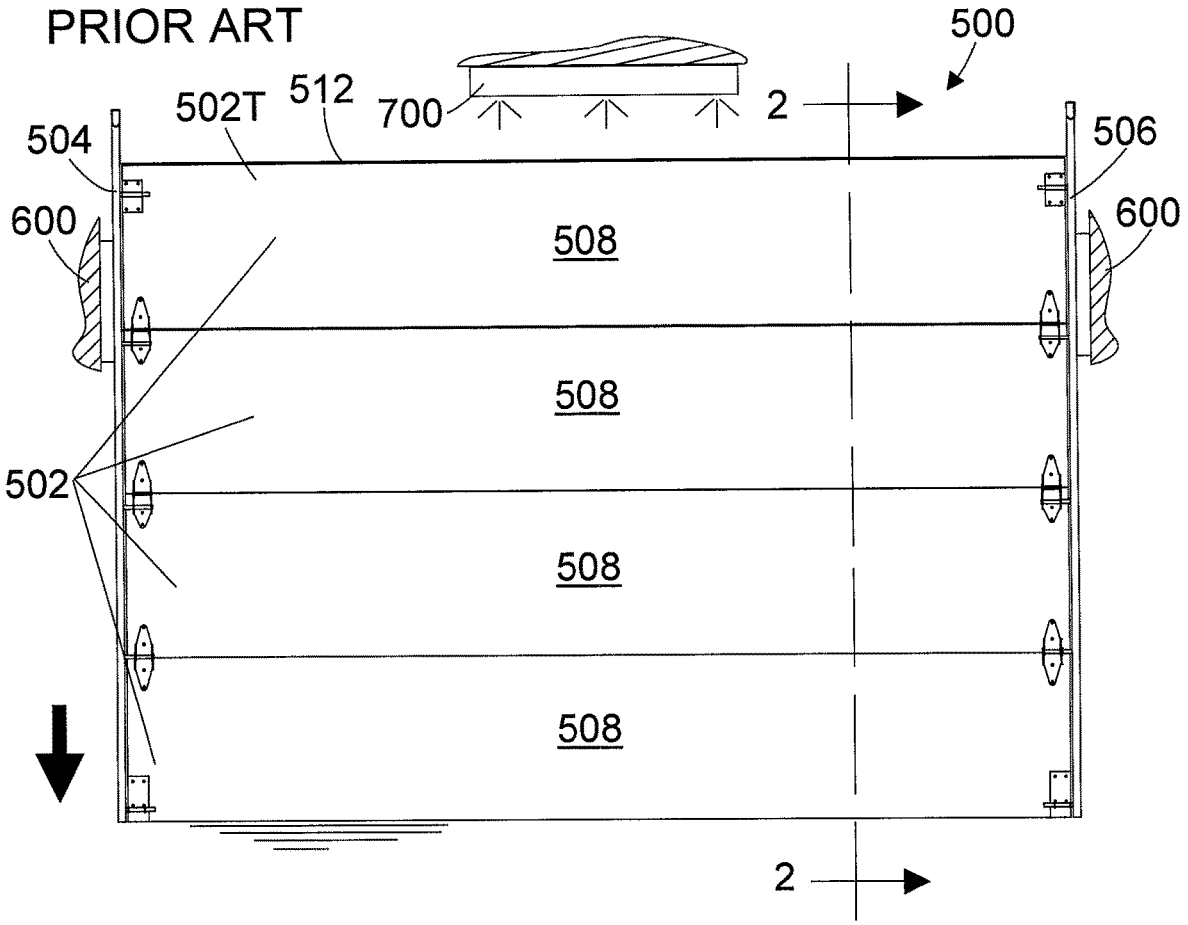
FIG. 1 PRIOR ART
FIG. 1 is an elevation view of the inside of a prior art sectional door showing the door in a closed substantially vertical position.
Figure 2:
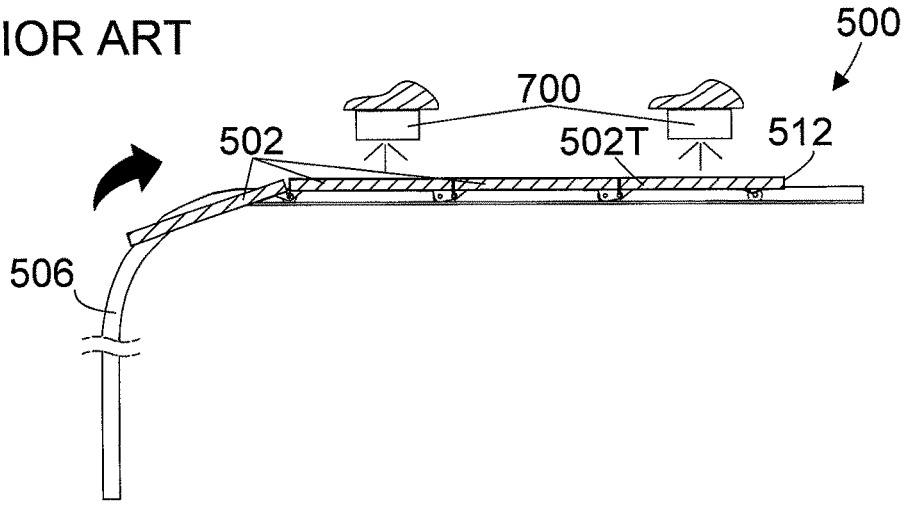
FIG. 2 PRIOR ART
FIG. 2 is a cross sectional view along the line 2-2 of FIG. 1 showing the sectional door in an open substantially horizontal overhead position.

FIGS. 1-8 depict a prior art lighting system for a sectional door as described in U.S. Pat. No. 9,976,738, which is herby incorporated by reference. Referring initially to FIG. 1 there is illustrated an elevation view of the inside of a prior art sectional door 500 showing the door in a closed substantially vertical position. FIG. 2 is a cross sectional view along the line 2-2 of FIG. 1 showing the sectional door in an open substantially horizontal overhead position. Sectional door 500 includes a plurality of connected panels 502 which roll along left 504 and right 506 tracks which are connected to a structure 600 (e.g. a building such as a garage or warehouse, or to a mobile structure (vehicle) such as a truck or delivery van). Each panel 502 has an inside surface 508. Panels 502 include a topmost panel 502T which has a top edge 512. Sectional door 500 is positionable to the closed position of FIG. 1, and to the open position of FIG. 2. It is noted that in the open position sectional door 500 blocks light coming from light fixtures 700. It is noted that a view in the opposite direction of FIG. 2 would be the mirror image.

Figure 3:
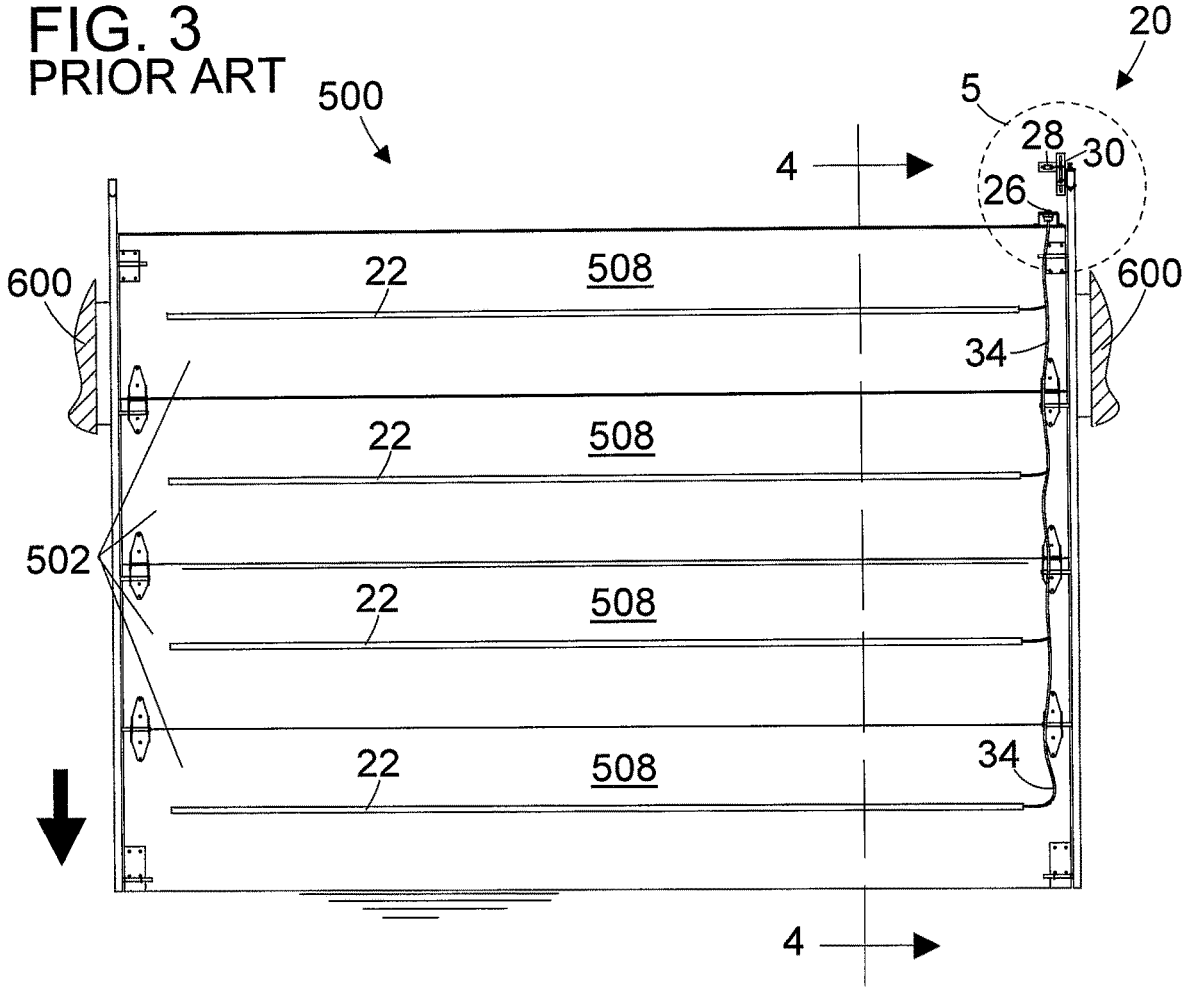
FIG. 3 PRIOR ART
FIG. 3 is an elevation view of the inside of the prior art sectional door with a lighting system installed.
Figure 4:
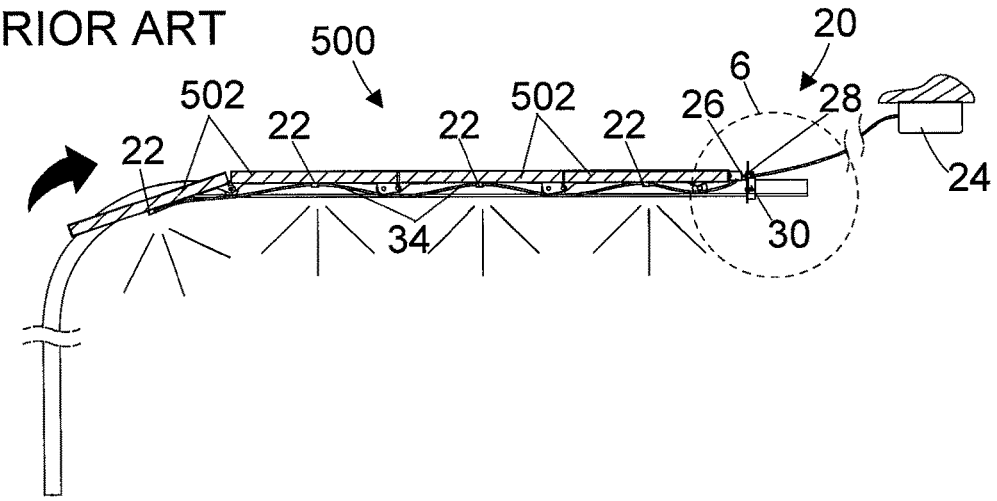
FIG. 4 PRIOR ART
FIG. 4 is a cross sectional view along the line 4-4 of FIG. 3.
Figure 5:
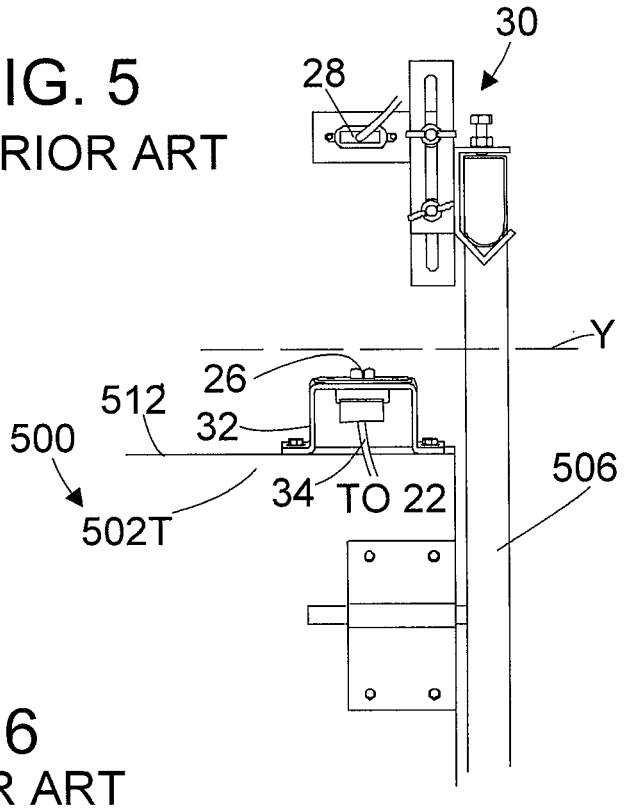
FIG. 5 PRIOR ART
FIG. 5 is an enlarged view of area 5 of FIG. 2.
Figure 6:
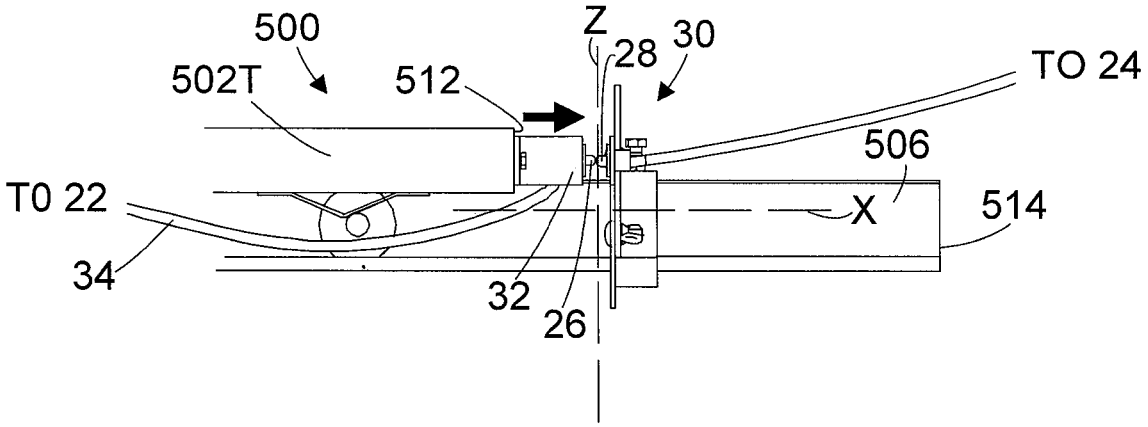
FIG. 6 PRIOR ART
FIG. 6 is an enlarged view of area 6 of FIG. 3.
Figure 7:
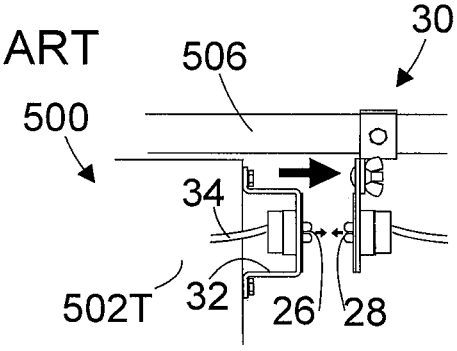
FIG. 7 PRIOR ART
FIG. 7 is a top plan view as in FIG. 6 just before electric contact is made.

FIG. 3 is an elevation view of the inside of the prior art sectional door 500 with a lighting system 20 installed, and FIG. 4 is a cross sectional view along the line 4-4 of FIG. 3. FIG. 5 is an enlarged view of area 5 of FIG. 3, FIG. 6 is an enlarged view of area 6 of FIG. 4, and FIG. 7 is a top plan view FIG. 6. Lighting system 20 includes a light 22 which is connectable to the inside surface 508 of a panel 502 of sectional door 500. As used herein the term "light" is defined as a device which produces light (e.g. a light bulb). In the shown embodiment, there are a plurality of lights 22, wherein one light 22 is connectable to each of the plurality of panels 502. Lights 22 are powered by a power supply 24. In an embodiment each light 22 includes a long strip (string) containing multiple lights (e.g. bulbs) which longitudinally extends along the panel 502. For a garage door application the strips can be about 16 feet long and therefore provide a large lighted area. The strips can be connected to the inside surface 508 of panel 502 with an adhesive or by other mechanical means. In an embodiment, light 22 includes a plurality of low voltage LED lights, such as high intensity daylight white 6000 k 5050 LED chip light strips. These lights are powered by. a 12 VDC 30A regulated power supply 24. Power supply 24 can be a separate unit as shown, or in some installations low voltage power can be taken from the door's motorized opening and closing mechanism. As used here the term low voltage means a voltage which is 0 to 49 volts.

Lighting system 20 further includes a movable electric contactor 26 which is connectable to a panel 502 (topmost panel 502T as shown) of sectional door 500. Lighting system 20 further includes a fixed electric contactor 28 which is connectable to the structure 600. As used herein the term "connectable to the structure" means either directly connectable or indirectly connectable. In the open position of the sectional door (FIGS. 4 and 6) movable electric contactor 26 is configured to contact fixed electric 28 contactor and thereby complete an electrical circuit which energizes light 22. In an embodiment the movable 26 and fixed 28 contactors are two pole low voltage electrical contacts. The contacts are made of metal and are longitudinally spring-biased to an extended position so that they maintain electrical contact with the opposing contacts (refer to small arrows on FIG. 7).

A holder 30 carries fixed contactor 28 (also refer to FIGS. 9-13). Holder 30 is shaped and dimensioned to removably connect to either the left track 504 or to the right track 506. In the shown embodiment, holder 30 is fixedly connected to track 504 or 506 with a bolt 31.

Referring specifically to FIGS. 5 and 6, movable electric contactor 26 is connectable to the topmost panel 502T of sectional door 500. In the shown embodiment a door holder 32 carries movable electric contactor 26. Door holder 32 is connectable to the top edge 512 of the topmost panel 502T such as with screws. Referring to FIG. 6, in the open position of sectional door 500, topmost panel 502T moves in the direction of the arrow so that movable electric contactor 26 contacts fixed electric contactor 28 to complete the lighting circuit. FIG. 7 shows moving contactor 26 moving in the direction of the arrow toward fixed contactor 28 just before the electrical connection is made.

Lighting system 20 further includes a wiring harness 34 which connects movable contactor 26 to light(s) 22. Harness 34 is mounted to the inside surface 508 of door panels 502 in such a way that it freely moves as the door panels 502 separate and transition from the vertical to horizontal position and back again during opening and closing operation. Harness 34 is can be connected to the door panels 502 by an adhesive or other mechanical means.

Figure 8:
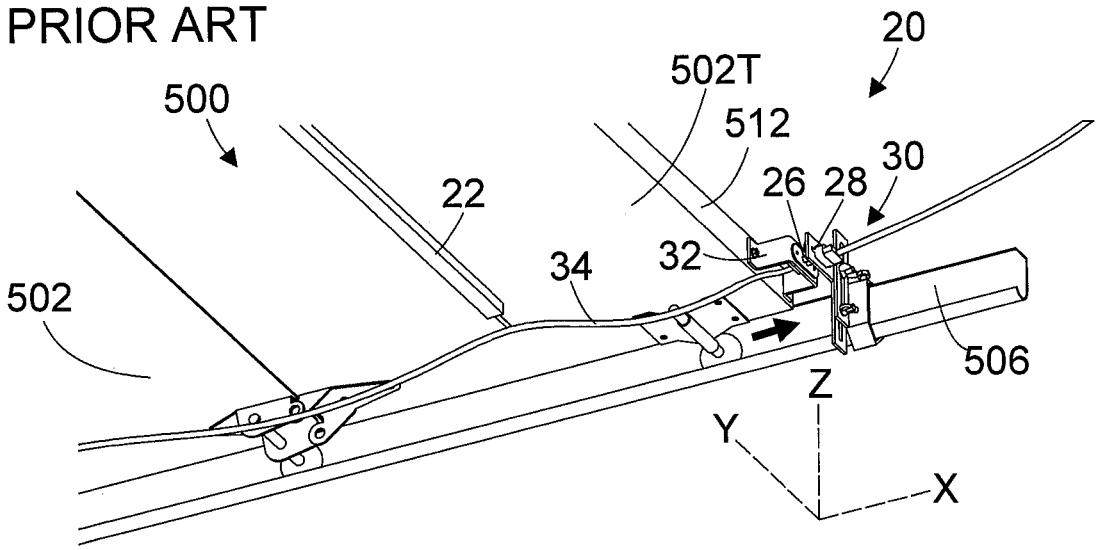
FIG. 8 PRIOR ART
FIG. 8 is an enlarged bottom perspective view of a movable electric contactor making contact with a fixed electric contactor.

FIG. 8 is an enlarged bottom perspective view of movable electric contactor 26 making contact with fixed electric contactor 28. Fixed electric contactor 28 is mounted to holder 30 which is connected to right track 506. Movable electric contactor 26 is mounted to door holder 32 which is connected to the top edge 512 of the topmost panel 502T of sectional door 500. Sectional door 500 is in the open horizontal overhead position wherein movable electric contactor 26 contacts fixed electric contactor 28 to complete the electrical circuit which energizes lights 22. Mutually perpendicular alignment axes X, Y, and Z are also shown (also refer to FIGS. 5 and 6).

Figure 9:
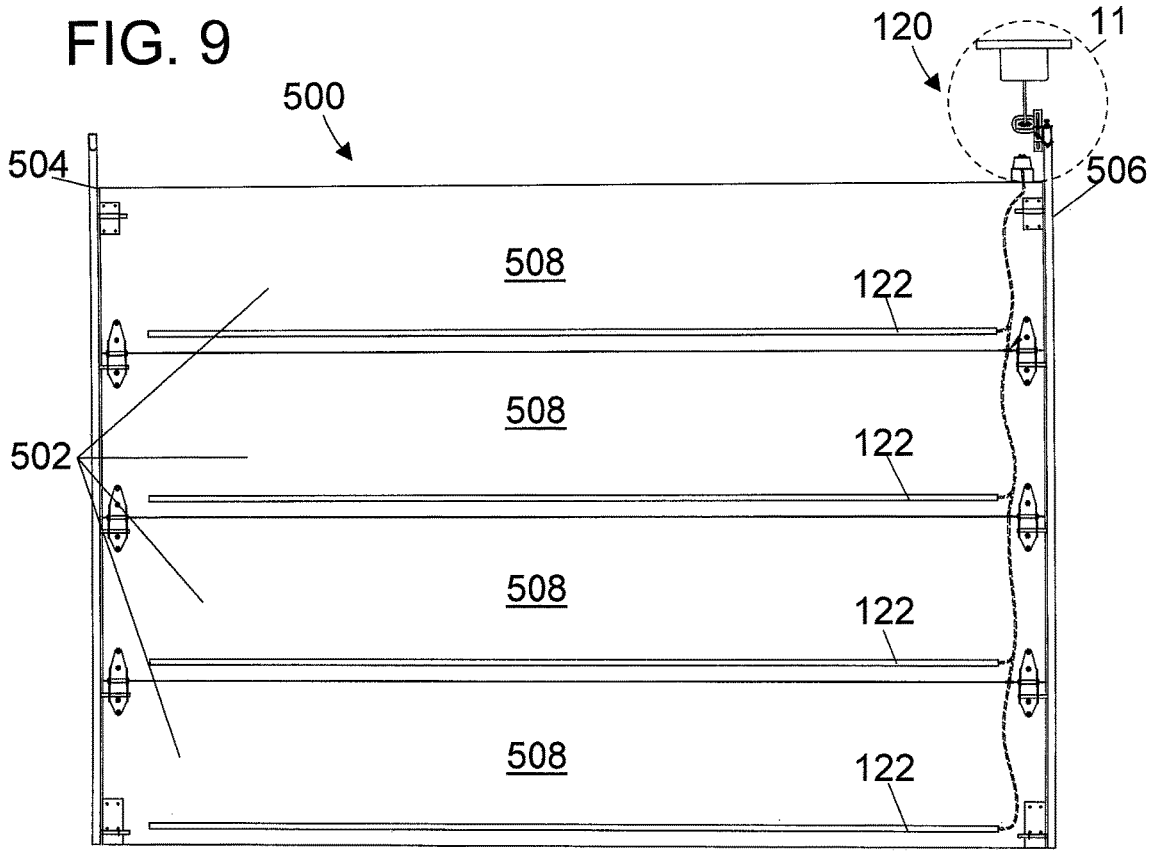
FIG. 9 is an elevation view of the inside of a sectional door in a closed substantially vertical position with the lighting system of the present invention installed.
Figure 10:
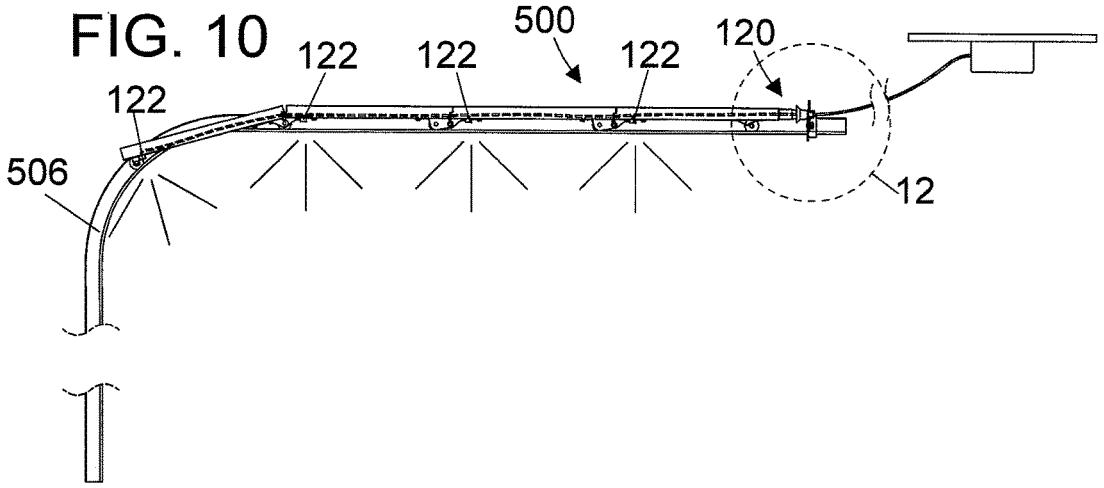
FIG. 10 is a side elevation view of the lighting system of FIG. 9 in an open substantially horizontal overhead position.

Now referring to FIGS. 9-21 there is illustrated a lighting system for a sectional door in accordance with the present invention, generally designated as 120. Lighting system 120 includes a means for ensuring the alignment of movable electric contactor 126 and fixed electric contactor 128 (refer to FIG. 21) that is not disclosed in lighting system 20. FIGS. 9 and 10 show a sectional door 500 in closed and open positions respectively. Sectional door 500 has a plurality of connected panels 502 which roll along left 504 and right 506 tracks which are connected to a structure such as a building or a vehicle. Each panel 502 has an inside surface 508. A light 122 is connectable to the inside surface 508 of a panel 502 of the sectional door 500. In the shown embodiment there are four panels 502 and four lights 122. A movable electric contactor 126 is connectable to a panel 502 of the sectional door 500. A fixed electric contactor 128 is carried by a holder 130 which is shaped and dimensioned to removably connect to either the left 504 track or to the right track 506. In the open position of the sectional door 500 the movable electric contactor 128 is configured to contact the fixed electric contactor 128 and energize light 122.

Figure 11:
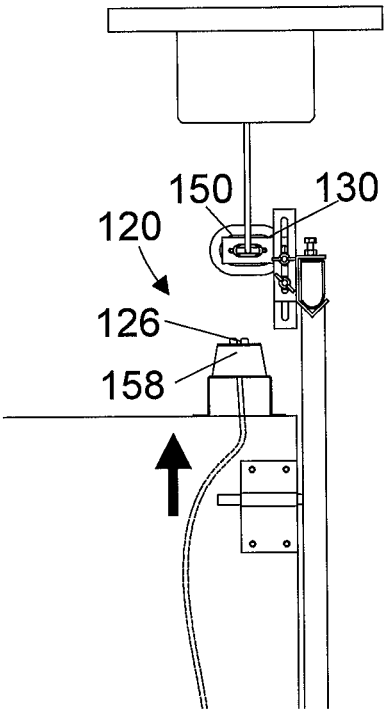
FIG. 11 is an enlarged view of area 11 of FIG. 9.
Figure 12:
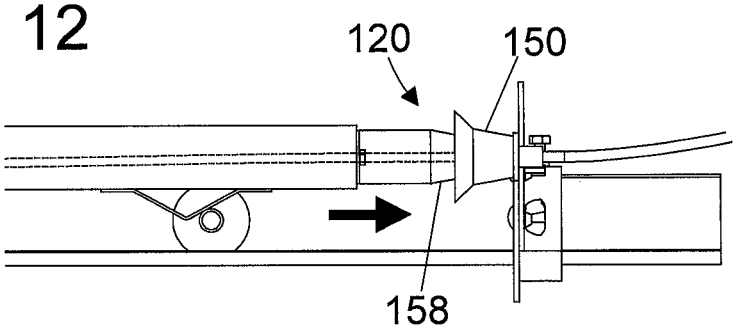
FIG. 12 is an enlarged view of area 12 of FIG. 10.
Figure 13:
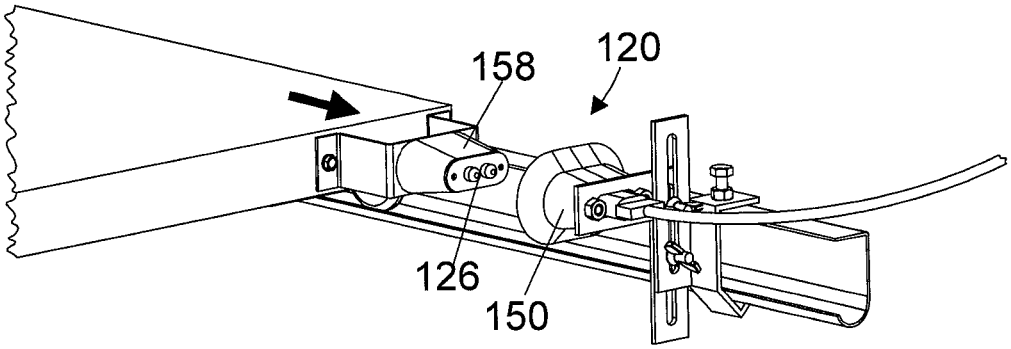
FIG. 13 is an enlarged fragmented bottom perspective view of a movable electric contactor positioned to make contact with a fixed electric contactor.
Figure 18:
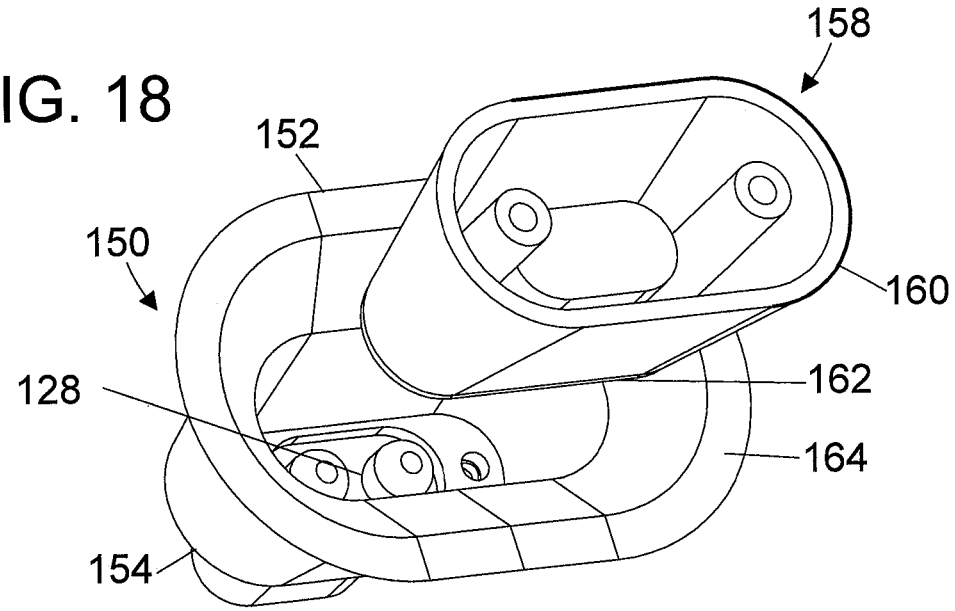
FIG. 18 is an enlarged perspective view of a tapered receptacle and a plug.
Figure 19:
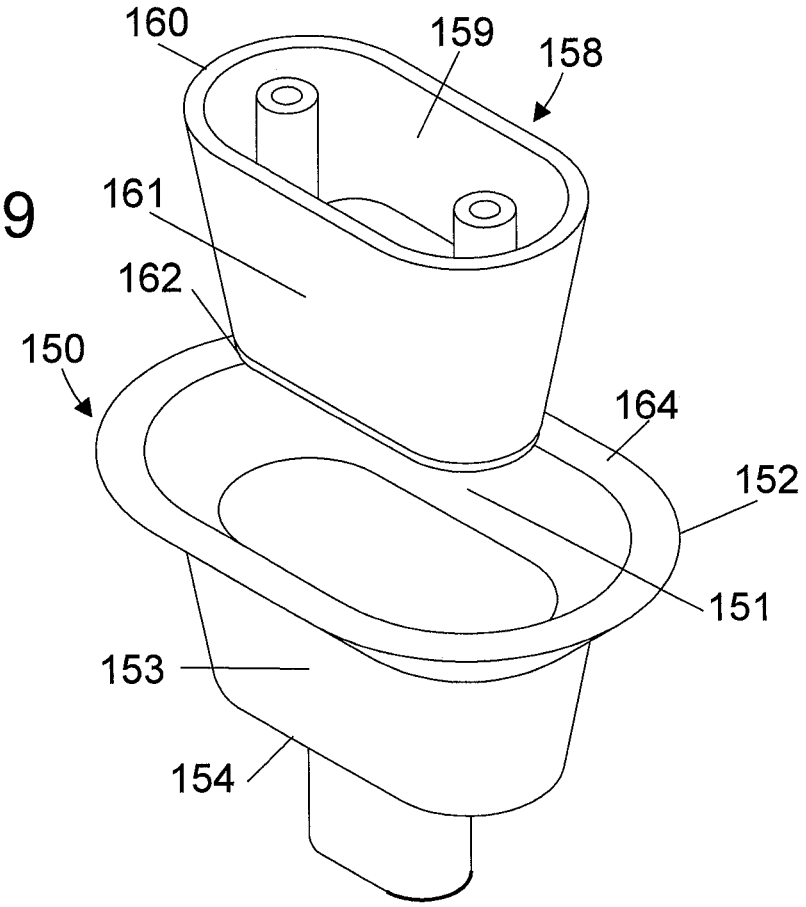
FIG. 19 is another enlarged perspective view of the tapered receptacle and plug.

Now referring to FIGS. 11-13 there is illustrated a tapered receptacle 150 having a mouth end 152 and a base end 154 (also refer to FIGS. 18 and 19). Tapered receptacle 150 downwardly tapers from the mouth end 152 to the base end 154. Fixed electric contactor 128 is connected to base end 154. A tapered plug 158 has a proximal end 160 and a distal end 162 (also refer to FIGS. 18, and 19). Tapered plug 158 downwardly tapers from proximal end 160 to said distal end 162. Movable electric contactor 126 is connected to distal end 162. Tapered plug 158 is shaped and dimensioned to be received by tapered receptacle 150. That is, tapered plug 158 fits into tapered receptacle 150 so that movable electric contactor 126 contacts fixed electric contactor 128 and completes an electrical circuit.

FIG. 11 is an enlarged view of area 11 of FIG. 9 when sectional door 500 is closed. Shown are tapered receptacle 150 which carries fixed electric contactor 128, and tapered plug 158 which carries movable electric contactor 126.

FIG. 12 is an enlarged view of area 12 of FIG. 10 when sectional door 500 is open. Tapered plug 158 has been received by tapered receptacle 150 so that movable electric contactor 126 contacts fixed electric contactor 128.

FIG. 13 is an enlarged fragmented bottom perspective view of movable electric contactor 126 positioned to make contact with fixed electric contactor 128. Shown are tapered receptacle 150 and tapered plug 158 with movable electric contactor 126.

FIG. 14 is a fragmented top plan view of movable electric contactor 126 on tapered plug 158 and fixed 128 electric contactor on tapered receptacle 150 with movable electric contactor 126 moving toward fixed electric contactor 128, and FIG. 15 is a fragmented top plan view as in FIG. 14 showing the movable electric contactor 126 contacting the fixed electric contactor 128. Tapered receptacle 150 and tapered plug 158 serve to bring movable electric contactor 126 into alignment with fixed electric contactor 128.

FIG. 16 is a fragmented top plan view showing the movable electric contactor 126 misaligned with the fixed electric contactor 128, Tapered receptacle 150 and tapered plug 158 serve to bring the two contactors into alignment. In an embodiment tapered plug 158 is laterally movable to effect alignment of movable electric contactor 126 with fixed electric contactor 128.

FIG. 17 is a fragmented top plan view showing an embodiment in which the position of tapered receptacle 150 and tapered plug 158 are reversed. That is tapered receptacle 150 is connected to a panel of the sectional door, and tapered plug 158 is connected to the holder. It is noted that this embodiment is somewhat less advantageous in that electrically active fixed connector 128 is now exposed.

FIG. 18 is an enlarged perspective view of disconnected tapered receptacle 150 and tapered plug 158, and FIG. 19 is another enlarged perspective view of tapered receptacle 150 and tapered plug 158. Shown are tapered receptacle 150 having mouth end 152 and base end 154 with fixed electric contactor 128 connected to base end 154, tapered plug 158 having proximal end 160 and distal end 162, with movable electric contactor connected to distal end 162. It is noted that tapered receptacle 150 has a flared flange 164 disposed at mouth end 152. Flared flange 154 tapers at a higher rate than the body of tapered receptacle 150. Flared flange can therefore accommodate greater misalignments of the movable 126 and fixed 128 electric contactors.

Figure 20:
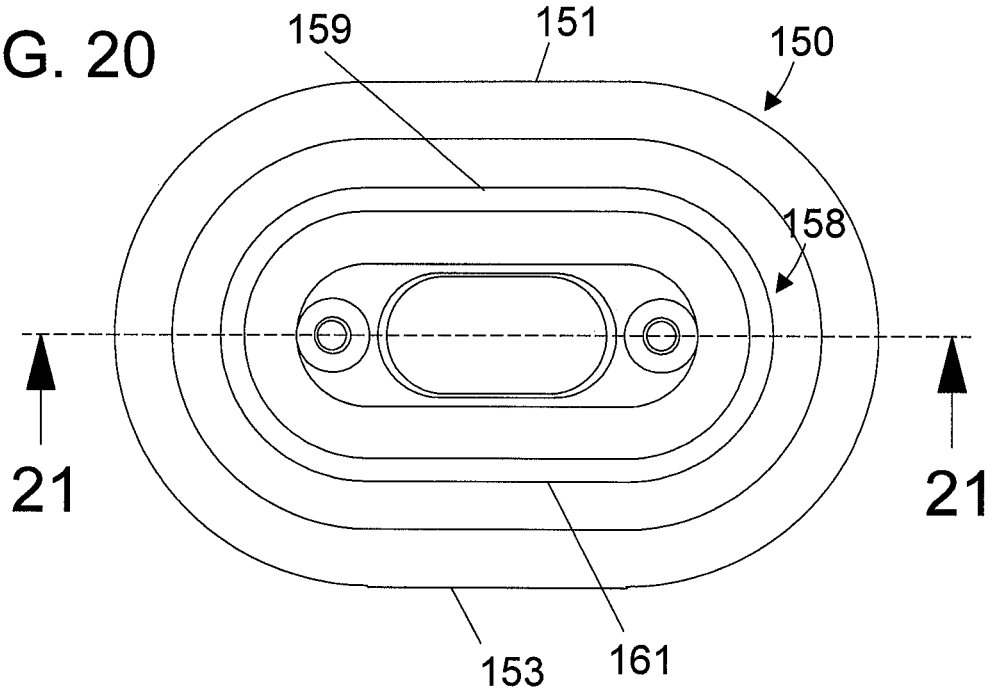
FIG. 20 is an enlarged top plan view of the tapered receptacle and tapered plug in a connected position; and, FIG. 21 is a cross sectional view along the line 21-21 of FIG. 20.
Figure 21:
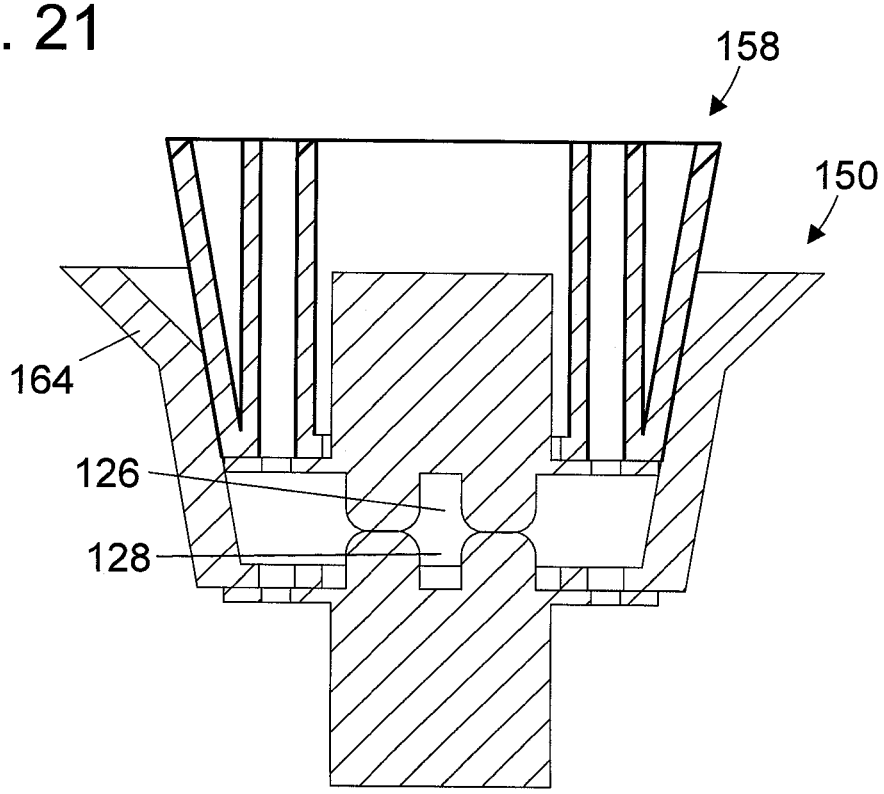

FIG. 20 is an enlarged top plan view of tapered receptacle 150 and tapered plug 158 in a connected position, and FIG. 21 is a cross sectional view along the line 21-21 of FIG. 20. Shown are tapered receptacle 150, tapered plug 158, moveable electric contactor 126, fixed electric contactor 128, and flared flange 164. In an embodiment tapered receptacle 150 has a first flat side 151 and an opposite second flat side 153. Similarly, tapered plug 158 has a first flat side 159 and an opposite second flat side 161.

The embodiments of the lighting system for a sectional door described herein are exemplary and numerous modifications, combinations, variations, and rearrangements can be readily envisioned to achieve an equivalent result, all of which are intended to be embraced within the scope of the appended claims. Further, nothing in the above-provided discussions of the lighting system should be construed as limiting the invention to a particular embodiment or combination of embodiments. The scope of the invention is defined by the appended claims.

I claim:

1. A lighting system for a sectional door having a plurality of connected panels which roll along left and right tracks which are connected to a structure, each panel having an inside surface, the sectional door is positionable to a closed position and to an open position, the lighting system comprising:

a light which is connectable to the inside surface of a panel of the sectional door;

a movable electric contactor which is connectable to a panel of the sectional door;

a fixed electric contactor;

a holder which carries said fixed contactor, said holder is shaped and dimensioned to removably connect to either the left track or to the right track;

in the open position of the sectional door said movable electric contactor is configured to contact said fixed electric contactor and energize said light;

a tapered receptacle having a mouth end and a base end, said fixed electric contactor connected to said base end;

a tapered plug having a proximal end and a distal end, said movable electric contactor connected to said distal end; and, said tapered plug shaped and dimensioned to be received by said tapered receptacle.

2. The lighting system according to claim 1, further including:

said tapered plug received by said tapered receptacle so that said movable electric contactor contacts said fixed electric contactor.

3. The lighting system according to claim 1, further including:

said tapered receptacle having a first flat side and an opposite second flat side; and, said tapered plug having a first flat side and an opposite second flat side.

4. The lighting system according to claim 1, further including:

said tapered receptacle having a flared flange disposed at said mouth end.

5. The lighting system according to claim 1, further including:

said tapered plug movable to effect alignment of said movable contactor with said fixed electric contactor.

6. A lighting system for a sectional door having a plurality of connected panels which roll along left and right tracks which are connected to a structure, each panel having an inside surface, the sectional door is positionable to a closed position and to an open position, the lighting system comprising:

a light which is connectable to the inside surface of a panel of the sectional door;

a movable electric contactor which is connectable to a panel of the sectional door;

a fixed electric contactor;

a holder which carries said fixed contactor, said holder is shaped and dimensioned to removably connect to either the left track or to the right track;

in the open position of the sectional door said movable electric contactor is configured to contact said fixed electric contactor and energize said light;

a tapered receptacle having a mouth end and a base end, said movable electric contactor connected to said base end;

a tapered plug having a proximal end and a distal end, said fixed electric contactor connected to said distal end; and, said tapered plug shaped and dimensioned to be received by said tapered receptacle.

7. The lighting system according to claim 6, further including:

said tapered plug received by said tapered receptacle so that said fixed electric contactor contacts said movable electric contactor.

8. The lighting system according to claim 6, further including:

said tapered receptacle having a first flat side and an opposite second flat side; and, said tapered plug having a first flat side and an opposite second flat side.

9. The lighting system according to claim 6, further including:

said tapered receptacle having a flared flange disposed at said mouth end.

10. The lighting system according to claim 6, further including:

said tapered receptacle movable to effect alignment of said movable contactor with said fixed electric contactor.

* * * * *